US010512817B2

(12) United States Patent
Hagen, III

(10) Patent No.: US 10,512,817 B2
(45) Date of Patent: Dec. 24, 2019

(54) FRONT SQUAT STABILITY APPARATUS

(71) Applicant: Derek D Dwayne Hagen, III, Webb Lake, WI (US)

(72) Inventor: Derek D Dwayne Hagen, III, Webb Lake, WI (US)

( * ) Notice: Subject to any disclaimer, the term of this patent is extended or adjusted under 35 U.S.C. 154(b) by 194 days.

(21) Appl. No.: 15/833,498

(22) Filed: Dec. 6, 2017

(65) Prior Publication Data

US 2019/0168064 A1 Jun. 6, 2019

(51) Int. Cl.

| | |
|---|---|
| ***A63B 71/00*** | (2006.01) |
| ***A63B 21/00*** | (2006.01) |
| *A63B 71/06* | (2006.01) |
| *A63B 21/072* | (2006.01) |

(52) U.S. Cl.

CPC ..... *A63B 21/4035* (2015.10); *A63B 71/0054* (2013.01); *A63B 21/0724* (2013.01); *A63B 2071/0655* (2013.01); *A63B 2209/00* (2013.01); *A63B 2209/10* (2013.01)

(58) Field of Classification Search

CPC ..... A63B 21/0724; A63B 21/4035; A63B 71/0054; A63B 2071/0655; A63B 2209/00; A63B 2209/10

See application file for complete search history.

(56) References Cited

U.S. PATENT DOCUMENTS

| | | | | |
|---|---|---|---|---|
| 10,335,630 | B2 * | 7/2019 | Buniak | A63B 21/4035 |
| 2011/0263391 | A1 * | 10/2011 | Welch | A63B 21/0724 482/93 |
| 2013/0029810 | A1 * | 1/2013 | Olivencia | A63B 71/0054 482/93 |
| 2016/0045809 | A1 * | 2/2016 | Jones | A63B 71/0054 428/100 |
| 2018/0021662 | A1 * | 1/2018 | Carpinelli | A63B 21/4005 482/104 |
| 2018/0125746 | A1 * | 5/2018 | Kokakis | A63B 21/0724 |

* cited by examiner

*Primary Examiner* — Joshua Lee
(74) *Attorney, Agent, or Firm* — Johnson and Phung LLC; Thomas N. Phung

(57) ABSTRACT

A front squat stability apparatus for supporting a barbell for performance of front squat exercises having a shoulder cushioning mat wrappingly securable about a barbell, the mat having a front face, a back face, a first end, a second end, a first side and a second side, a fastening system securing the first end to the back face of the mat, a rope having a first end secured to the mat proximal the second end and at a midpoint between the sides of the mat, a second end, and a hand grasping region, and an elongated orifice located between the first end of the mat and the first end of the rope with the elongated orifice extending parallel to the sides of the mat and sized for receiving the second end of the rope multiple times therethrough to wrappingly secure the mat to the barbell.

20 Claims, 4 Drawing Sheets

FRONT SQUAT STABILITY APPARATUS

FIELD OF THE INVENTION

This invention relates generally to exercise devices and, more specifically to an apparatus attachable to weight lifting squat bars to assist weight lifters and workout enthusiast in providing stability and correct form in performing their front squat exercises.

CROSS REFERENCE TO RELATED APPLICATIONS

None.

STATEMENT REGARDING FEDERALLY SPONSORED RESEARCH OR DEVELOPMENT

None

REFERENCE TO A MICROFICHE APPENDIX

None

BACKGROUND OF THE INVENTION

Front free weight squats are a great exercise for bodybuilders, powerlifters, all types of athletes, and for people with various fitness goals. Front free weight squats require that the weight lifting bar be positioned across the individual's shoulders in front of the neck with the lifter using his or her hands to hold the bar in place.

However, one of the problems associated with front squat is that front squats are often time difficult to perform properly not only for the novices but also for seasoned bodybuilders due to excess baggage in movement involved in performing front squats.

Using various type of grip types for front squats has advantages and disadvantages. For example, the Olympic clean style grip provides the lifter with increased stability due to a wider bar rack. However, the Olympic clean style grip requires great flexibility in the joints of the lifter's shoulder, elbow and wrist and thus is difficult to perform for most individuals, especially those with shoulder, elbow or wrist problems.

The crossed arm style grip does not require as much shoulder, elbow and wrist flexibility but is less stable due to a narrower bar rack and thus is also more difficult for the lift to keep the bar from rolling back into the throat, or down the arms.

Due to the above problems, front squats are usually not frequently performed by novice gym members and are often times not perform to the full lifting potential of the seasoned lifters.

SUMMARY OF THE INVENTION

The present invention solves the traditional problems associated with front squat by provide for a front squat stability apparatus for assisting user support of a barbell in a proper position for performance of front squat exercises while reducing the excess baggage in movement involved in performing front squat exercises, comprising a shoulder cushioning mat wrappingly securable about a midway portion between the ends of a barbell. The shoulder cushioning mat includes a front face, a back face, a first end, a second end, a first side and a second side.

The front squat stability apparatus also includes a hook-and-loop fastening system for securement of the first end of the shoulder cushioning mat to the back face of the shoulder cushioning mat. The hook-and-loop fastening system generally comprises a plurality of small hair-like loops extending proximal the first end of the front face of the shoulder cushioning mat and directly securable to a plurality of flocked fibers extending proximal the second end of the back face of the of the shoulder cushioning mat.

The front squat stability apparatus further includes a high strength ring located on the shoulder cushioning mat proximal the second end of the shoulder cushioning mat, a heavy-duty nylon braided rope having a first end secured to the high strength ring, a slippage preventing flathead knot located proximal a second end of the braided rope, and a hand grasping region located between the first end of the braided rope and the flathead knot.

The front squat stability apparatus also includes an elongated tightening orifice located between the first end of the shoulder cushioning mat and the high strength ring with the elongated tightening orifice extending parallel to the sides of the shoulder cushioning mat. The elongated tightening orifice is sized for receiving the second end of the braided rope along with the flathead knot multiple times therethrough for wrapping securement of the shoulder cushioning mat to a portion of the barbell.

DESCRIPTION OF THE PREFERRED EMBODIMENT

The present invention relates to exercise devices and, more specifically to an apparatus attachable to weight lifting squat bars such as barbells to assist weight lifters and workout enthusiast in providing stability and correct form in performing their front squat exercises.

Figure 1:
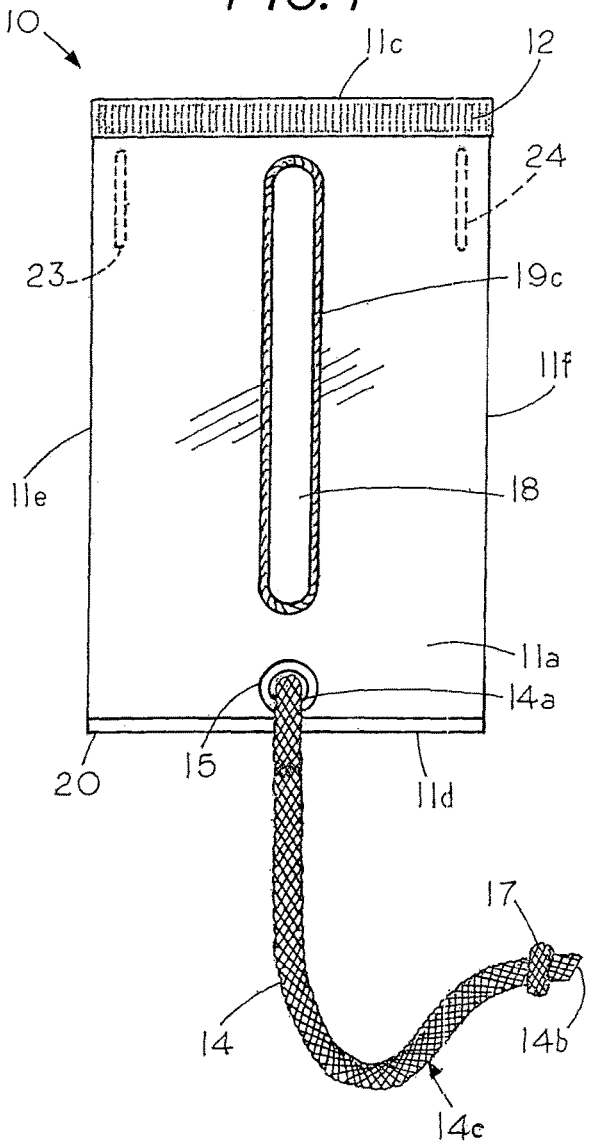
FIG. 1 is a front view a front squat stability apparatus for assisting user support of a barbell in a proper position for performance of front squat exercises.
Figure 2:
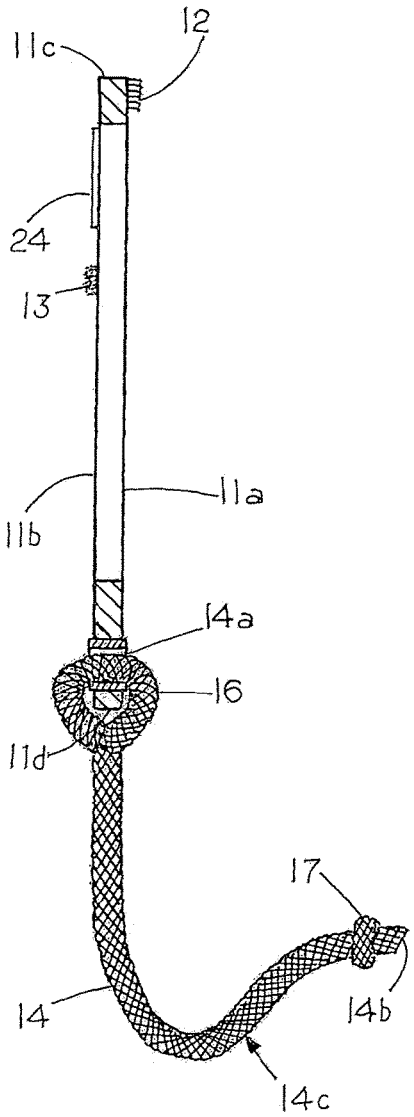
FIG. 2 is a cross-sectional-side view of the front squat stability apparatus of FIG. 1.
Figure 4:
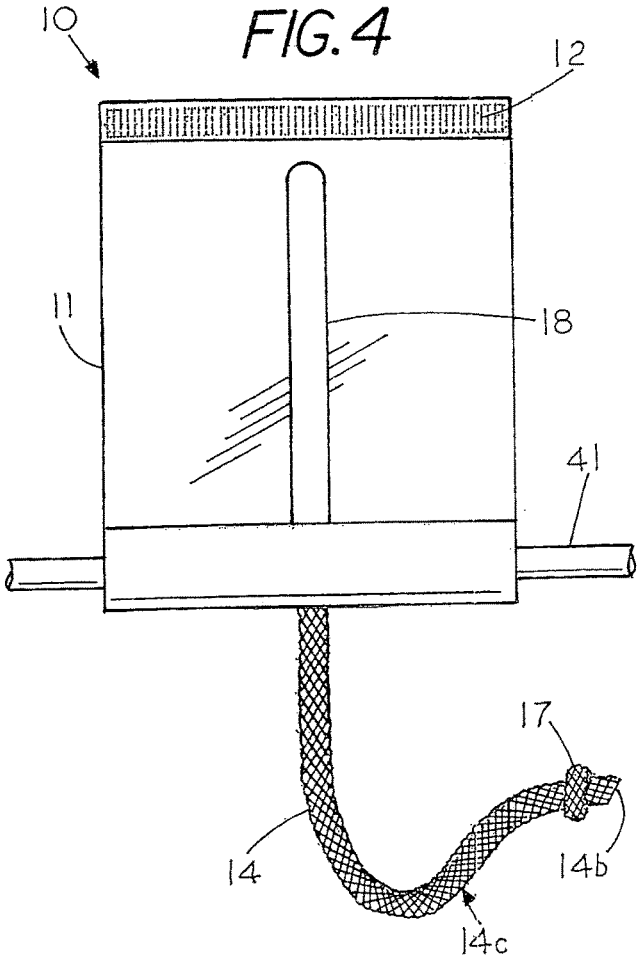
FIG. 4 is a front view showing the wrapping securement of the front squat stability apparatus of FIG. 1 to a barbell.

Referring to the drawings, FIG. 1 is a front view and FIG. 2 is a cross-sectional-side view showing an embodiment a front squat stability apparatus 10 for assisting user support of a barbell in a proper position for performance of front squat exercises of the present invention generally comprising a shoulder cushioning mat 11 wrappingly securable about a midway portion between the ends of a barbell (shown in FIG. 4). The shoulder cushioning mat 11 includes a front face 11*a*, a back face 11*b*, a first end 11*c*, a second end 11*d*, a first side 11*e* and a second side 11*f*. The width of shoulder cushioning mat 11 is sized to conformed to the shoulder size of the user to provide visual and touch indicator for proper shoulder placement for distributing the weight of the bar more evenly over the user's shoulders.

Front squat stability apparatus 10 also includes a fastening system for securement of the first end 11*c* of the shoulder cushioning mat 11 to the back face 11*b* of shoulder cushioning mat 11. Although a variety of fastening systems may be used with the present invention including but not limited to a button based fastening system, a strap based fastening system, a rivet mechanical fastening system, the embodiment of FIGS. 1 and 2 show a hook-and-loop fastening system comprising a plurality of small hair-like loops 12 extending on the front face 11*a* and along and proximal the first end 11*c* of the shoulder cushioning mat 11. Plurality of small hair-like loops 12 are directly securable to a plurality of flocked fibers 13 extending along and proximal the second end 11*d* of the back face 11*b* of the of the shoulder cushioning mat 11.

It is noted that alternative embodiments of the present invention may comprise hook-and-loop fastening system comprising a first strip of fabric and a second strip of fabric with the first strip of fabric having a first side securable to the front face 11*a* of the shoulder cushioning mat 11 and a second side having a plurality of small hair-like loops extending therefrom and the second strip of fabric having a first side securable to the back face 11*b* of the shoulder cushioning mat 11 and a second side having a plurality of flocked fibers extending therefrom for securable engagement with the plurality of small hair-like loops of the first strip of fabric. It is noted that hook-and-loop fasteners are generally identified or commonly known by the brand name Velcro®, which is owned by the company Velcro Industries of the Netherlands.

Front squat stability apparatus 10 also includes a heavy-duty braided rope 14 having a first end 14*a*, a second end 14*b*, and a hand grasping region 14*c* located between the first end 14*a* and the second end 14*b* of braided rope 14. It is noted that although braided rope 14 may comprises a variety of material, widths, and lengths, in the embodiment of FIGS. 1 and 2 braided rope 14 comprises a width of at least 0.75 inches and preferably at least 1 inches and a length of between 10 to 36 inches. It is further noted that alternative embodiments of the present invention may comprise a braided rope that may be adjustable in length to conform for use by individuals of varying arm lengths.

Braided rope 14 may also include a device such as an enlarged second end to prevent the user's grip from slipping off of the braided rope 14. FIGS. 1 and 2 braided rope 14 is shown as having a slippage preventing flathead knot 17 located proximal the second end 14*b* of braided rope 14.

In the embodiment of FIGS. 1 and 2 the first end 14 of braided rope 14 is secured to the shoulder cushioning mat 14 proximal the second end 11*d* of the shoulder cushioning mat 14 and at a midpoint between the first side 11*e* and second side 11*f* of the shoulder cushioning mat 14. Although braided rope 14 may be secured to shoulder cushioning mat 14 by a variety of means, FIGS. 1 and 2 shows braided rope 14 secured to shoulder cushioning mat 11 through the use of a high strength ring 15 located on shoulder cushioning mat 11 connected to an eye loop 16 located at the first end 14*a* of braided rope 14. It is noted that high strength ring 15 may comprise a plurality of materials including but not limited to rugged stainless steel, various metal alloys, high strength polymer plastic, high-strength fiberglass, high strength hardened rubber, and the like.

Front squat stability apparatus 10 also includes an elongated tightening orifice 18 located between the first end 11*c* of shoulder cushioning mat 11 and the first end 14*a* of braided rope 14 and extending parallel to the sides 11*e* and 11*f* of shoulder cushioning mat 11. Elongated tightening orifice 18 may also include a re-enforced tear-resistant stitching surrounding the perimeter of elongated tightening orifice 18. Similarly, the second end 11*d* of shoulder cushioning mat 11 may also include a re-enforced tear-resistant stitching 20. The heavy duty re-enforced stitching 19 and 20 at the elongated tightening orifice 18 and the second end 11*d* of shoulder cushioning mat 11 will function to improve the tightening strength and life span of the front squat stabilizing apparatus 10.

A feature of the present invention is that elongated tightening orifice 18 is sized for receiving the second end 14*b* of braided rope 14 along with the slippage preventing device on the braided rope 14, if there is one, multiple times therethrough for wrapping securement of shoulder cushioning mat 11 to a portion of a barbell.

FIGS. 1 and 2 also show front squat stability apparatus 10 having an option feature of a first tactile shoulder alignment member 23 located between the elongated tightening orifice 18 and the first side 11*e* of shoulder cushioning mat 11 and a second tactile shoulder alignment member. 24 located between the elongated tightening orifice 18 and the second side 11*f* of shoulder cushioning mat 11 with tactile shoulder alignment members 23 and 24 extending from the back face 11*b* of shoulder cushioning mat 11 proximal the first end 11*c* of shoulder cushioning mat 11 and equal distance from the elongated tightening orifice 18. Tactile shoulder alignment members 23 and 24 function to provide the user with proper non-visual positioning of the barbell with respect to the user's shoulder during performance of front squat exercises.

Figure 3:
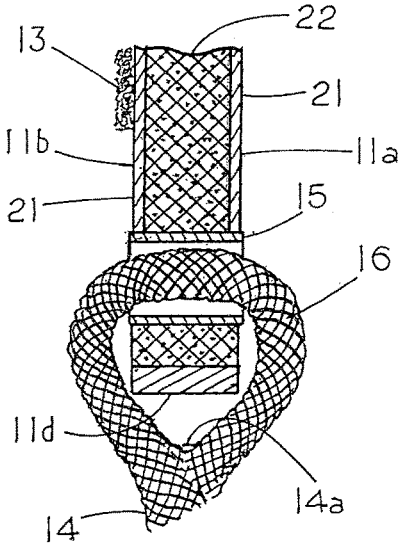
FIG. 3 is a close-up cross-sectional view showing the connection between a high strength ring of shoulder cushioning mat and an eye loop of a braided rope.

FIG. 3 is a close-up cross-sectional view showing the connection between the high strength ring 15 located on shoulder cushioning mat 11 and the eye loop 16 located at the first end 14*a* of braided rope 14. FIG. 3 also shows shoulder cushioning mat 11 as comprising a waterproof tear-resistant skin 21 supporting a cushioning material such as a memory foam 22 therein. Although shoulder cushioning mat 11 shows the use of memory foam 22 as the cushioning material, alternative cushioning materials including but not limited to a gel-base, polyurethane foam-based, cotton-based, and latex-based cushioning material and/or their various combinations may be used.

Figure 5:
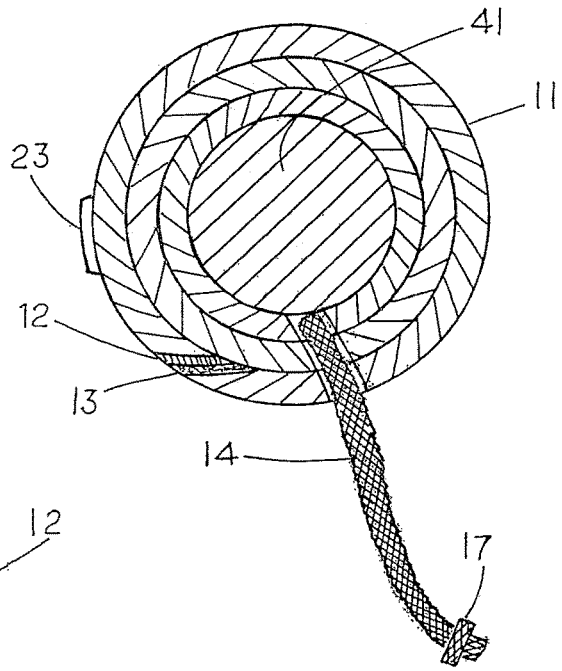
FIG. 5 is a cross-sectional side view showing the front squat stability apparatus of FIG. 1 completely wrapped about the barbell.

Referring to FIGS. 4 and 5, FIG. 4 is a front view showing the wrapping securement of front squat stability apparatus 10 to a barbell 41 by tightly wrapping braided rope 14 around a mid-portion (between the ends) of barbell 41 and then extending the second end 14*b* of braided rope 14 along with flathead knot 17 through elongated tightening orifice 18 and then repeating the aforementioned steps multiple times until the first end 11*c* of shoulder cushioning mat 11 engages the back face 11*b* of shoulder cushioning mat 11.

FIG. 5 is a cross-sectional side view of front squat stability apparatus 10 completely wrapped about barbell 41 with the plurality of small hair-like loops 12 directly attached to the plurality of flocked fibers 13 securing the first end 11*c* of shoulder cushioning mat 11 to the back face 11*b* of shoulder cushioning mat 11.

Figure 6:
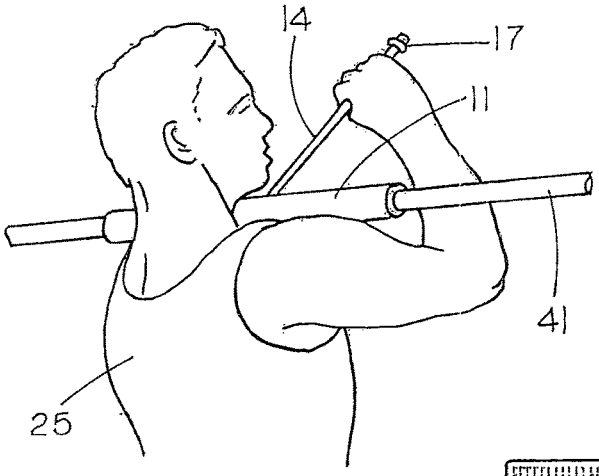
FIG. 6 is a perspective view showing front squat stability apparatus of FIG. 1 in use.

FIG. 6 is a perspective view showing the use of front squat stability apparatus 10 of the present invention. In use of front squat stability apparatus 10 a user 25 places his or her shoulders under the barbell 41 with the front squat stability apparatus 10 wrapped around it. The user 25 then adjust the position of the barbell 41 so that the weights of the barbell 41 are evenly distributed on the user's shoulders. Proper positioning of the barbell 41 on the user's shoulder may be assisted by the shoulder alignment members 23 and 24 initially and throughout the front squat exercise. The user 25 then grabs a hold of the rope 14 with both hands with the palms of the user's hands facing each other. The user 25 then lifts the weight off the squat racks and begin the front squat exercise.

If the barbell 41 is not supported by a squat rack the user 25 must first lift the barbell 41 with the front squat stability apparatus 10 wrapped around it up to the user's shoulders. While supporting the portion of the bar containing the front squat stability apparatus 10 on the user's shoulder the user 25 adjust the position of the barbell 2a3 so that the weights of the barbell 41 are evenly distributed on the user's shoulders. The user 25 then grabs a hold of the rope 14 with both hands with the palms of the user's hands facing each other. The user 25 then lifts the weight off the squat racks and begin the front squat exercise.

The use of the front squat stability apparatus 10 in performing front squat provides numerous benefits including but not limited to reducing compression on the user's chess cause by the weight of the barbell 41 thereby allowing the user 25 to breathe better, enhancing the user's 25 grip and control of the barbell 41 during the front squat exercise, and reducing stress on the user's wrists and joints. In addition, by keeping the user's hands in front of him or her it becomes easier to sit back through the movement and shift the focus to the quads, hamstrings, and glutes. Since the shoulder cushioning mat 10 and not the barbell is directly engaging the user's shoulder the shoulder cushioning mat 10 also help to maintain the comfort of the shoulders and chest throughout the front squat exercise.

Figure 7:
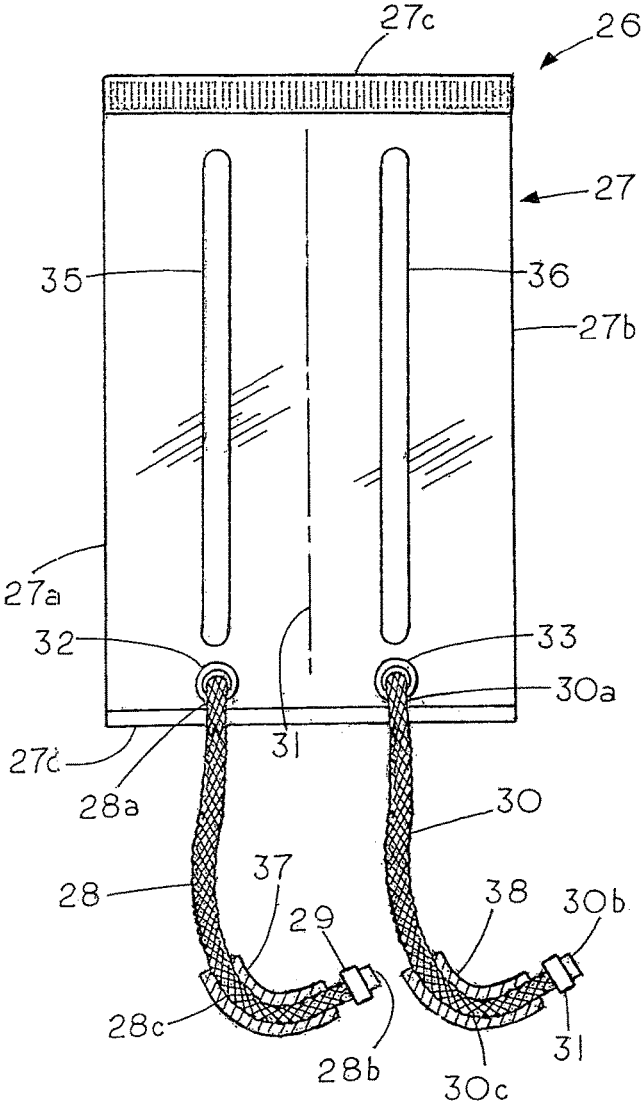
FIG. 7 is a front showing an alternative embodiment a front squat stability apparatus.

FIG. 7 is a front showing an alternative embodiment a front squat stability apparatus 26 for assisting user support of a barbell in a proper position for performance of front squat exercises of the present invention.

Front squat stability apparatus 26 generally comprises similar component as front squat stability apparatus 10 of FIGS. 1-6. However, unlike the front squat stability apparatus 10 of FIGS. 1-6, front squat stability apparatus 26 includes a first heavy-duty nylon braided rope 28 and a second heavy-duty nylon braided rope 30.

The first heavy-duty nylon braided rope 28 includes a first end 28a, a second end 28b, a slippage preventing enlarged rubber end 29 located proximal second end 28b, and a hand grasping region 28c located between the first end 28a and enlarged rubber end 29 of braided rope 28. The second heavy-duty nylon braided rope 30 includes a first end 30a, a second end 30b, a slippage preventing enlarged rubber end 31 located proximal second end 30b, and a hand grasping region 30c located between the first end 30a and enlarged rubber end 31 of braided rope 30.

The first end 28a of rope 28 is secured to a first metal ring 32 located proximal a second end 27d of a shoulder cushioning mat 27 and between a first side 27a of shoulder cushioning mat 27 and a midpoint axis 34 between the first side 27a and the second side 27b of shoulder cushioning mat 27. The first end 30a of rope 30 is secured to a second metal ring 33 located proximal second end 27c of shoulder cushioning mat 27 and between the second side 27b of shoulder cushioning mat 27 and the midpoint axis 34 of shoulder cushioning mat 27.

Front squat stability apparatus 10 also includes a first elongated tightening orifice 35 located between a first end 27c of shoulder cushioning mat 27 and the first end 28a of braided rope 28 and extending parallel to the sides 27a and 27b of shoulder cushioning mat 27 and a second elongated tightening orifice 36 located between the first end 27c of shoulder cushioning mat 27 and the first end 30a of braided rope 30 and extending parallel to the sides 27a and 27b of shoulder cushioning mat 27.

A feature of the present invention is that elongated tightening orifice 35 is sized for receiving the second end 28b of braided rope 28 along with enlarged rubber end 29 multiple times therethrough and elongated tightening orifice 36 is sized for receiving the second end 30b of braided rope 30 along with enlarged rubber end 31 multiple times therethrough for wrapping securement of shoulder cushioning mat 27 to a portion of a barbell.

The embodiment of FIG. 7 also shows the hand grasping regions 28c and 30c of braided ropes 28 and 30 each including a grip cushioning sleeve 37 and 38 to protect the user's hands and wrists during use of the front squat stability apparatus 26.

Figure 8:
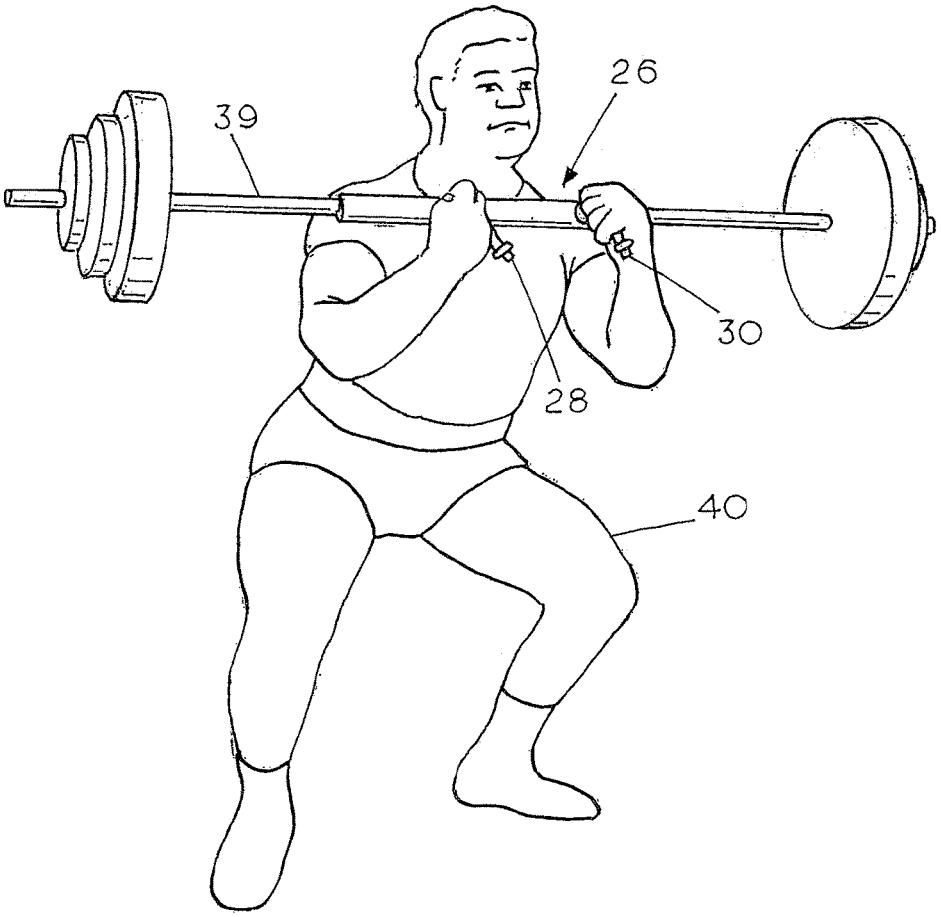
FIG. 8 is a perspective view showing the use of front squat stability apparatus of FIG. 7.

FIG. 8 is a perspective view showing the use of front squat stability apparatus 26. Similar to front squat stability apparatus 10 of FIGS. 1-6, in use of front squat stability apparatus 27 a user 40 places his or her shoulders under the barbell 39 with the front squat stability apparatus 26 wrapped around it. The user 40 then adjust the position of the barbell 39 so that the weights of the barbell 39 are evenly distributed on the user's shoulders. The user 40 then grabs a hold of the first rope 28 with a first hand and grabs a hold of the second rope 30 with the user's second hand. The user then lifts the weight off the squat racks and begin the front squat exercise.

If the barbell 39 is not supported by a squat rack the user 40 must first lift the barbell 39 with the front squat stability apparatus 26 wrapped around it up to the user's shoulders. While supporting the portion of the bar containing the front squat stability apparatus 26 on the user's shoulder the user 40 adjusts the position of the barbell 39 so that the weights of the barbell 39 are evenly distributed on the user's shoulders. The user 40 then grabs a hold of the first rope 28 with a first hand and grabs a hold of the second rope 30 with the user's second hand. The user then lifts the weight off the squat racks and begin the front squat exercise.

I claim:

1. A front squat stability apparatus for supporting a barbell in a proper position for performance of front squat exercises by a weight lifter comprising:

a shoulder cushioning mat wrappingly securable about a midway portion between the ends of a barbell, said shoulder cushioning mat having a front face, a back face, a first end, a second end, a first side and a second side;

a fastening system for securement of said first end of said shoulder cushioning mat to said back face of said shoulder cushioning mat;

a heavy-duty braided rope having a first end, a second end, and a hand grasping region located between said first end and said second end of said braided rope, said first end of said braided rope secured to said shoulder cushioning mat proximal said second end of said shoulder cushioning mat and at a midpoint between said first side and said second side of said shoulder cushioning mat; and an elongated tightening orifice located between said first end of said shoulder cushioning mat and said first end of said braided rope, said elongated tightening orifice extending parallel to said sides of said shoulder cushioning mat, said elongated tightening orifice sized for receiving said second end of said braided rope multiple times therethrough for wrapping securement of said shoulder cushioning mat to a portion of a barbell.

2. The front squat stability apparatus of claim 1 including a high strength ring located on said shoulder cushioning mat and said first end of said braided rope is secured to said high strength ring.

3. The front squat stability apparatus of claim 1 wherein said braided rope includes a slippage preventing flathead knot located proximal said second end of said braided rope and said elongated tightening orifice is sized for receiving said second end of said braided rope along with said flathead knot multiple times therethrough for wrapping securement of said shoulder cushioning mat to a portion of a barbell.

4. The front squat stability apparatus of claim 1 wherein said fastening system comprises a hook-and-loop fastening system for securement of said first end of said shoulder cushioning mat to said back face of said shoulder cushioning mat, said hook-and-loop fastening system including a plurality of small hair-like loops extending from said front face and proximal said first end of said shoulder cushioning mat and directly securable to a plurality of flocked fibers extending from said back face and proximal said second end of said shoulder cushioning mat.

5. The front squat stability apparatus of claim 1 wherein said shoulder cushioning mat comprises a waterproof tear-resistant skin supporting a memory foam therein.

6. The front squat stability apparatus of claim 1 wherein said elongated tightening orifice and said second end of said shoulder cushioning mat includes a re-enforced tear-resistant stitching.

7. The front squat stability apparatus of claim 2 wherein said first end of said braided rope comprises an eye loop secured to said high strength ring.

8. The front squat stability apparatus of claim 2 wherein said high strength ring comprises stainless steel, metal alloys, high strength polymer plastic, high-strength fiberglass, or high strength hardened rubber.

9. The front squat stability apparatus of claim 1 including a first tactile shoulder alignment member located between said elongated tightening orifice and said first side of said shoulder cushioning mat and a second tactile shoulder alignment member located between said elongated tightening orifice and said second side of said shoulder cushioning mat, said tactile shoulder alignment members extending from said back face of said shoulder cushioning mat proximal said first end of said shoulder cushioning mat and equal distance from said elongated tightening orifice to provide proper non-visual positioning of said barbell with respect to the user's shoulder during performance of front squat exercises.

10. The front squat stability apparatus of claim 1 wherein said hand grasping region of said braided rope includes a grip cushioning sleeve to protect the hands and wrists during use of said front squat stability apparatus.

11. A front squat stability apparatus for assisting user support of a barbell in a proper position for performance of front squat exercises comprising:

a shoulder cushioning mat wrappingly securable about a midway portion between the ends of a barbell, said shoulder cushioning mat having a front face, a back face, a first end, a second end, a first side and a second side;

a hook-and-loop fastening system for securement of said first end of said shoulder cushioning mat to said back face of said shoulder cushioning mat, said hook-and-loop fastening system including a plurality of small hair-like loops extending from said front face proximal said first end of said shoulder cushioning mat and directly securable to a plurality of flocked fibers extending from said back face and proximal said second end of said shoulder cushioning mat;

a high strength ring located on said shoulder cushioning mat proximal said second end of said shoulder cushioning mat;

a heavy-duty nylon braided rope having a first end secured to said high strength ring, a slippage preventing flathead knot located proximal a second end of said braided rope, and a hand grasping region located between said first end of said braided rope and said flathead knot; and an elongated tightening orifice located between said first end of said shoulder cushioning mat and said high strength ring, said elongated tightening orifice extending parallel to said sides of said shoulder cushioning mat, said elongated tightening orifice sized for receiving said second end of said braided rope along with said flathead knot multiple times therethrough for wrapping securement of said shoulder cushioning mat to a portion of a barbell.

12. The front squat stability apparatus of claim 11 wherein said shoulder cushioning mat comprises a waterproof tear-resistant skin supporting a memory foam therein.

13. The front squat stability apparatus of claim 12 wherein said elongated tightening orifice and said second end of said shoulder cushioning mat includes a re-enforced tear-resistant stitching.

14. The front squat stability apparatus of claim 13 wherein said first end of said braided rope comprises an eye loop secured to said high strength ring.

15. The front squat stability apparatus of claim 14 wherein said high strength ring comprises stainless steel, metal alloys, high strength polymer plastic, high-strength fiberglass, or high strength hardened rubber.

16. The front squat stability apparatus of claim 15 including a first tactile shoulder alignment member located between said elongated tightening orifice and said first side of said shoulder cushioning mat and a second tactile shoulder alignment member located between said elongated tightening orifice and said second side of said shoulder cushioning mat, said tactile shoulder alignment members extending from said back face of said shoulder cushioning mat proximal said first end of said shoulder cushioning mat and equal distance from said elongated tightening orifice to provide proper non-visual positioning of said barbell with respect to the user's shoulder during performance of front squat exercises.

17. The front squat stability apparatus of claim 15 wherein said hand grasping region of said nylon braided rope includes a grip cushioning sleeve to protect the hands and wrists during use of said front squat stability apparatus.

18. A front squat stability apparatus for assisting user support of a barbell in a proper position for performance of front squat exercises comprising:

a shoulder cushioning mat wrappingly securable about a midway portion between the ends of a barbell, said shoulder cushioning mat having a front face, a back face, a first end, a second end, a first side and a second side;

a hook-and-loop fastening system for securement of said first end of said shoulder cushioning mat to said back face of said shoulder cushioning mat, said hook-and-loop fastening system including a plurality of small hair-like loops extending from said front face and proximal said first end of said shoulder cushioning mat and directly securable to a plurality of flocked fibers extending from said back face and proximal said second end of said shoulder cushioning mat;

a first metal ring located proximal said second end of said shoulder cushioning mat and between said first side of said shoulder cushioning mat and a midpoint axis between said first side and said second side of said shoulder cushioning mat;

a second metal ring located proximal said second end of said shoulder cushioning mat and between said second side of said shoulder cushioning mat and said midpoint axis between said first side and said second side of said shoulder cushioning mat, said metal rings positioned equal distance proximal said second end of said shoulder cushioning mat;

a first heavy-duty nylon braided rope having a width of at least one inch in diameter, a first end secured to said first metal ring, a slippage preventing enlarged rubber end located proximal a second end of said braided rope, and a hand grasping region located between said first end of said braided rope and said enlarged rubber end;

a second heavy-duty nylon braided rope having a width of at least one inch in diameter, a first end secured to said second metal ring, a slippage preventing enlarged rubber end located proximal a second end of said braided rope, and a hand grasping region located between said first end of said braided rope and said enlarged rubber end;

a first elongated tightening orifice located between said first end of said shoulder cushioning mat and said first metal ring; and a second elongated tightening orifice located between said first end of said shoulder cushioning mat and said second metal ring, said elongated tightening orifices extending parallel to said sides of said shoulder cushioning mat, said first elongated tightening orifice sized for receiving said second end of said first braided rope along with said enlarged rubber end multiple times therethrough and said second elongated tightening orifice sized for receiving said second end of said second braided rope along with said enlarged rubber end multiple times therethrough for wrapping securement of said shoulder cushioning mat to a portion of a barbell.

19. The front squat stability apparatus of claim 18 wherein said shoulder cushioning mat comprises a waterproof tear-resistant skin supporting a memory foam therein.

20. The front squat stability apparatus of claim 18 including a first tactile shoulder alignment member located between said first elongated tightening orifice and said first side of said shoulder cushioning mat and a second tactile shoulder alignment member located between said second elongated tightening orifice and said second side of said shoulder cushioning mat, said tactile shoulder alignment members extending from said back face of said shoulder cushioning mat proximal said first end of said shoulder cushioning mat and equal distance from said midpoint between said first side and said second side of said shoulder cushioning mat to provide proper non-visual positioning of said barbell with respect to the user's shoulder during performance of front squat exercises.

* * * * *